United States Patent [19]

Bächinger et al.

[11] Patent Number: 4,809,920

[45] **Date of Patent: * Mar. 7, 1989**

[54] METHOD AND APPARATUS FOR FORMING A WADDING LAP

[75] Inventors: Peter Bächinger, Weinfelden; Mondini Giancarlo, Winterthur, both of Switzerland

[73] Assignee: Maschinenfabrik Rieter AG, Winterthur, Switzerland

[ * ] Notice: The portion of the term of this patent subsequent to Jun. 16, 2004 has been disclaimed.

[21] Appl. No.: 892

[22] Filed: Jan. 6, 1987

Related U.S. Application Data

[63] Continuation of Ser. No. 704,292, Feb. 22, 1985, Pat. No. 4,673,137.

[30] Foreign Application Priority Data

Mar. 15, 1984 [CH] Switzerland ..... 1299/84

[51] Int. Cl.[4] ..... B65H 18/20

[52] U.S. Cl. ..... 242/55.1; 242/66; 19/161.1; 28/103

[58] Field of Search ..... 242/55.1, 66, 65; 19/106 R, 296, 161.1; 28/103; 100/173, 167, 86, 89, 210

[56] References Cited

U.S. PATENT DOCUMENTS

| | | | |
|---|---|---|---|
| 530,001 | 11/1984 | Bessonette | 100/86 |
| 928,563 | 7/1909 | Thoens | 100/210 X |
| 1,509,730 | 9/1924 | Hughes | 100/210 X |
| 1,698,088 | 1/1929 | Franke | 100/167 |
| 1,830,325 | 11/1931 | Leonard | 100/173 X |
| 2,094,086 | 9/1937 | Webb | 19/149 |
| 3,134,553 | 5/1964 | DeGelleke | 242/56 R |
| 3,245,625 | 4/1966 | Quinn | 242/55.1 |
| 3,284,012 | 11/1966 | Stafford | 242/55.1 |
| 3,313,005 | 4/1967 | Moon | 242/55.1 X |
| 3,315,908 | 4/1967 | Wetzler | 242/55.1 X |
| 3,791,288 | 2/1974 | Whitehurst | 242/55.1 X |
| 3,981,047 | 9/1976 | Contractor et al. | 19/296 |

FOREIGN PATENT DOCUMENTS

| | | |
|---|---|---|
| 5561833 | 3/1983 | Switzerland . |
| 680464 | 10/1952 | United Kingdom . |
| 1150651 | 4/1969 | United Kingdom . |

*Primary Examiner*—John M. Jillions
*Attorney, Agent, or Firm*—Michael J. Striker

[57] ABSTRACT

In a lap winding apparatus for forming a wadding lap from a wadding web, a lap receiving tube or the wadding lap formed thereon is supported on two winding rollers. On both sides of the winding rollers, support arms are provided which in the upper end region have means for receiving the tube and at the lower end region are connected with a pivoting mechanism which is operated by a pneumatic cylinder arrangement. Calender rollers compress the wadding web before the winding thereof. In order to prevent as far as possible "breathing" of the wadding web between the last calender rollers and the wadding lap a smoothing plate condenses the wadding web shortly before reaching the wadding lap for a last time. The smoothing plate is resiliently secured on both sides of the winding rollers to respective swing arms. On both sides of the winding rollers there is provided a respective swing arm and a force transmitting lever fixedly secured to a sleeve. In order to hold the smoothing plate at a substantially constant distance from the wadding lap that gradually increases in size in operation, the force transmitting levers are pivoted by rollers secured to carrier arms.

19 Claims, 14 Drawing Sheets

Fig. 7
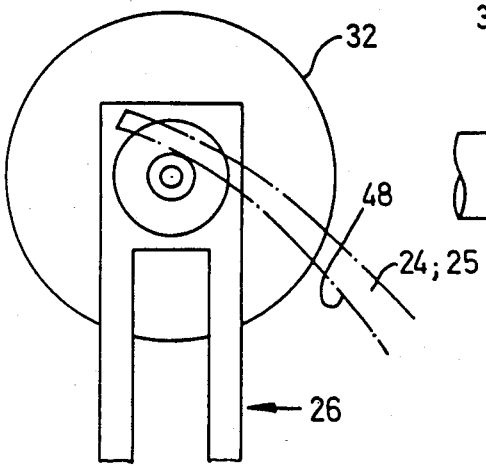
Fig. 7a
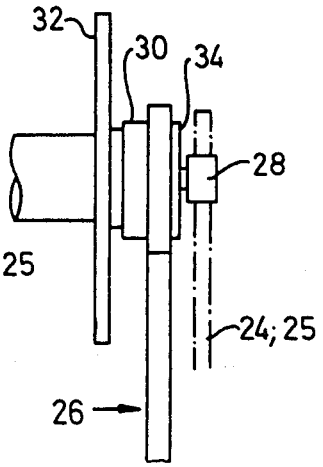
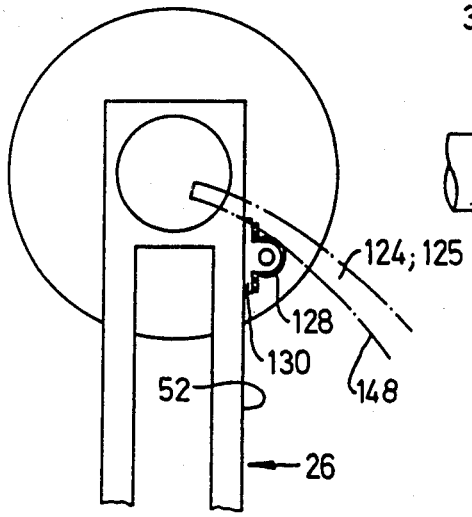
Fig. 8
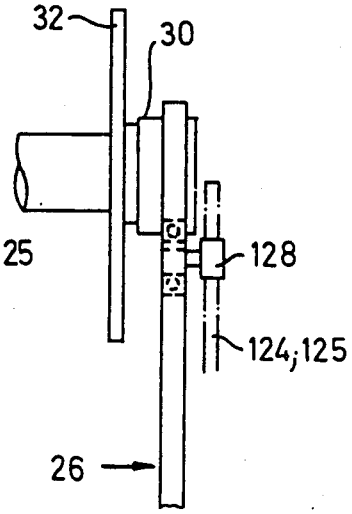
Fig. 8a

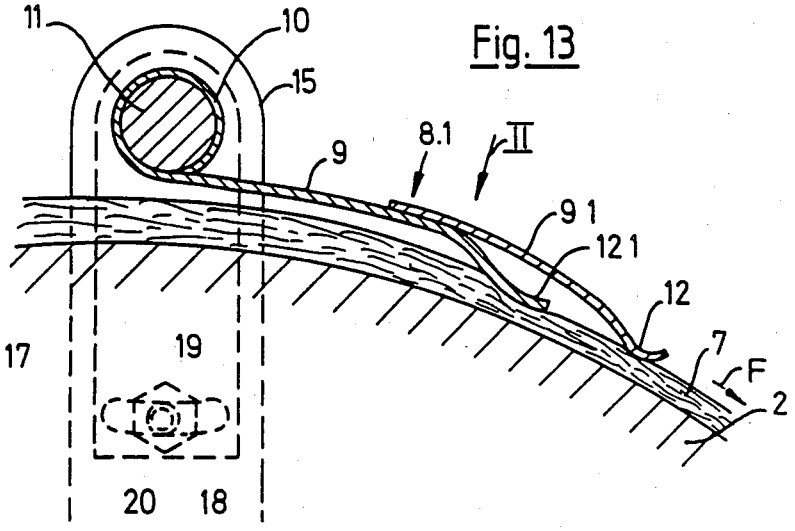
Fig. 13
Fig. 14
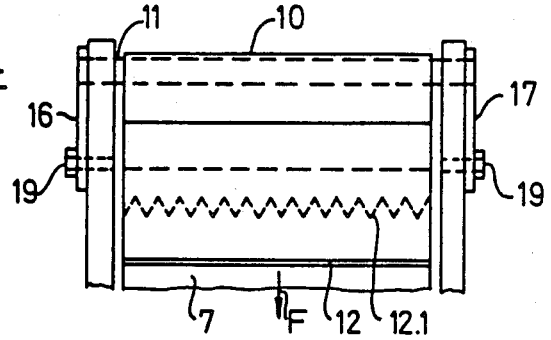
Fig. 15
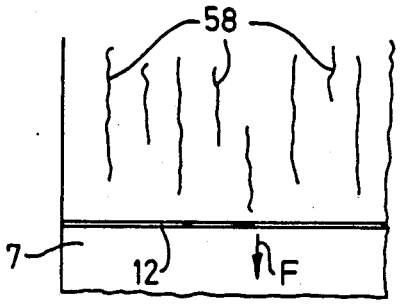
Fig. 16
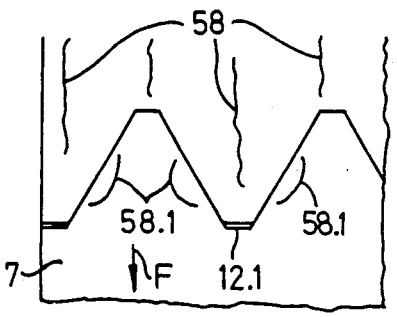

56
301
334
312
318
315
317
320
311
313
321
300
314
308
6
310
319
316
5
309
342
332
305
307
37
38
329
302
323
7
8
330
F
322
4
331
57
23
36
39
2
51
26;27
43
44
3
42
46
47

METHOD AND APPARATUS FOR FORMING A WADDING LAP

This is a continuation of application Ser. No. 704,292, filed Feb. 22, 1985, now U.S. Pat. No. 4,673,137.

BACKGROUND OF THE INVENTION

The present invention relates to forming laps from fibrous webs in general, and more particularly to a method of and an apparatus for forming wadding laps from wadding webs.

In the process of handling fibrous materials, for instance, prior to spinning, it is often necessary to form laps from webs of such fibrous material. Then, such laps may be used as the feed material for a ribbon lap machine and a subsequent combing process and apparatus.

In the formation of laps, two essential aims are, on the one hand, the achievement of a high specific weight of the material of the lap and, on the other hand, problem-free subsequent unrolling of the lap, that is, the avoidance of mutual entaglement of the fibers from any two adjacent or superimposed layers of the lap. In order to achieve these objectives, it has been previously proposed to subject the webs to so-called calendering prior to the formation of the laps from such webs. During such calendering operation, the advancing web is continuously pressed two or three times between calendering rollers and is drawn to a slight degree, so that condensing or compaction of the material of the web takes place.

In conventional arrangements utilizing this principle, the web either rests freely on one of two winding rollers between the last or downstream pair of calendering rollers and the lap-forming location, that is, the location at which the web first contacts the tube forming the core of the lap or the previous lap layer, or hangs freely between the last calender roller pair and the lap-forming location, that is, it is suspended unsupported in the air or, in other words, it is held only in the nip of the last calender roller pair and in the nip between the outer layer of the lap and the upstream winding roller. This brings about a substantial disadvantage, in that the web material "breathes" subsequent to the calendering operation, so that the thickness of the web again increases with respect to that at which the web leaves the nip between the last calendering roller pair. Thus, the material of the lap will have a reduced specific density. Also, experience has shown that the fibers of the superimposed layers of the lap may become entangled with one another, which creates problems during the unwinding of the lap.

SUMMARY OF THE INVENTION

Accordingly, it is a general object of the present invention to avoid the disadvantages of the prior art.

More particularly, it is an object of the present invention to provide a method of forming a lap from a fibrous web, which method does not result in the disadvantages of the known methods of this type.

Still another object of the present invention is to develop a method of the type here under consideration which would result in an increased density of the lap material and in reduction or elimination of the danger of entanglement between fibers of superimposed layers of the lap.

A concomitant object of the present invention is to devise an apparatus capable of performing the method of the present invention.

It is yet another object of the present invention so to construct the apparatus of the type here under consideration as to be relatively simple in construction, inexpensive to manufacture, easy to use, and reliable in operation nevertheless.

In pursuance of these objects and others which will become apparent hereafter, one feature of the present invention resides in a method of forming a lap from a fibrous web, this method comprising the steps of advancing the web in a predetermined path to a lap-forming location; forming the lap from the web at the lap-forming location; calendering the web in the path upstream of the lap-forming location; and preparing the web for the forming step in the path after the calendering step and prior to reaching the lap-forming location. The preparing step advantageously includes condensing or compressing the fibrous material of the web and/or causing the fibers of the web to assume substantially random dispositions at least at one of the major surfaces of the web. It is particularly advantageous when the preparing step is performed immediately upstream of the location at which the web passes onto the lap.

According to another concept of the present invention, there is provided a winding apparatus for forming a lap from a fibrous web, which apparatus comprises means for winding the web at a lap-forming location into the lap with attendant advancement of the web in a predetermined path toward the lap-forming location, such winding means including two winding rollers which support the lap during the winding of the latter; means for calendering the web in the path upstream of the lap-forming location; and means for preparing the web for the formation of the lap therefrom, such preparing means being situated between the calendering means and the lap-forming location. Advantageously, the preparing means includes a smoothing plate that is so arranged as to press the web against that of the winding rollers that is arranged along the path upstream of the lap-forming location to thereby condense or compress the material of the web. The smoothing plate advantageously has a smoothing edge extending substantially transversely of the web and arranged at the downstream end of the smoothing plate as considered in the advancement direction of the web. The smoothing edge, or an additional smoothing edge which is arranged on the smoothing plate upstream of the aforementioned smoothing edge, may be provided with a row of teeth arranged next to one another as considered transversely of the web, these teeth then contacting the fibers of the web and changing their distribution or disposition.

A particular advantage of the method and apparatus of the present invention is that the web is condensed again after it has left the area of operation of the calendering means and shortly before it is wound onto the lap. It is particularly advantageous in this respect, in accordance with another facet of the present invention, when the smoothing plate is so mounted for movement and so moved by associated moving means in dependence on the diameter of the lap already formed, or on the position of a component of the apparatus which is dependent on or proportional to the extent of displacement of the core tube of the lap and thus the diameter of the lap that the smoothing edge is always situated at the nip region between the web and either initially the core tube or later a layer of the web previously deposited on the core tube or on another web layer. In this manner, the condensation or compression of the web always takes place in the immediate vicinity of the lap-forming location, that is, the nip region of the lap.

A further advantage of the present invention is to be seen in the fact that the condensing function can be advantageously combined with the function of producing a random distribution of the fibers in the upper layer of the web. In this connection, it is especially advantageous to provide the combination of the first or upstream edge which is provided with the randomizing or reorienting teeth with the second or downstream smoothing edge which has merely a straight bending edge or a bulge that contacts the web and compresses the same downstream of the toothed smoothing edge.

The advantage of the formation of a random distribution of the fibers at the upper major surface of the web can be explained by referring to the fact that the originally substantially parallel fibers of the fibrous wadding web are more inclined to become entangled with the similarly distributed and oriented fibers at the other major surface of the fibrous web which become interposed with the fibers of the opposite major surface upon juxtaposition of such major surfaces with one another in the lap in the absence of such random distribution which does not have its counterpart with respect to the fibers of the lower major surface of the web than in the presence of such random distribution. In other words, the random distribution of the upper fiber layer of the fibrous web at one of the major surfaces of the web produces a similar effect and a similar advantage as the formation of a crosswound thread package does in comparison with the formation of a package with parallel windings. In other words, the individual fibers at the two juxtaposed major surfaces will partially cross each other rather than become interleaved with one another, thus reducing the danger or entanglement to a minimum.

The novel features which are considered as characteristic of the invention are set forth in particular in the appended claims. The improved lap winding apparatus for fibrous webs itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIGS. 7, 8 and 9 are side elevational views of certain details of the lap winding apparatus of FIG. 1, 2 and 3, respectively;

Figure 1:
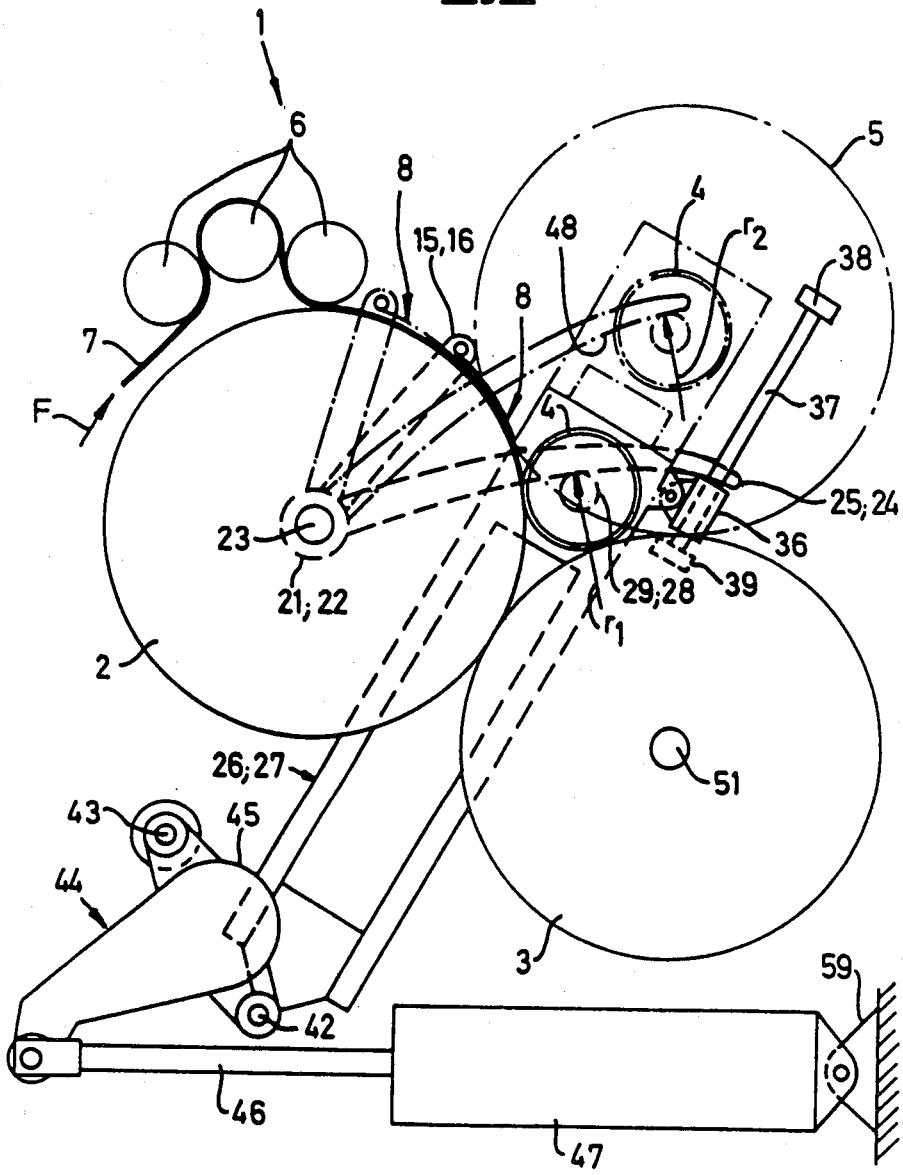
FIG. 1 is a partly diagrammatic side elevational view of a section of a lap winding apparatus in accordance with the invention.
Figure 2:
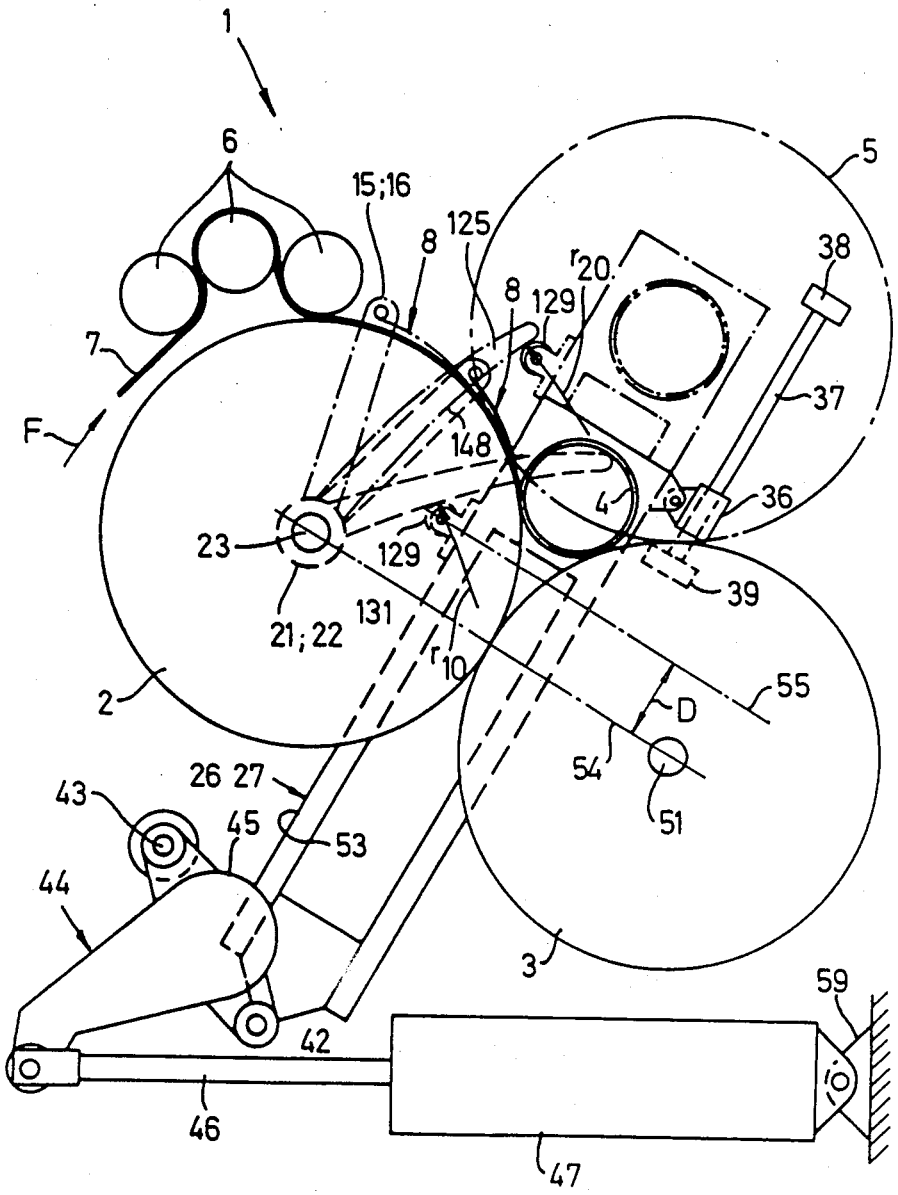
FIGS. 2 and 3 are views similar to FIG. 1 but showing respective modifications of the lap winding apparatus.
Figure 3:
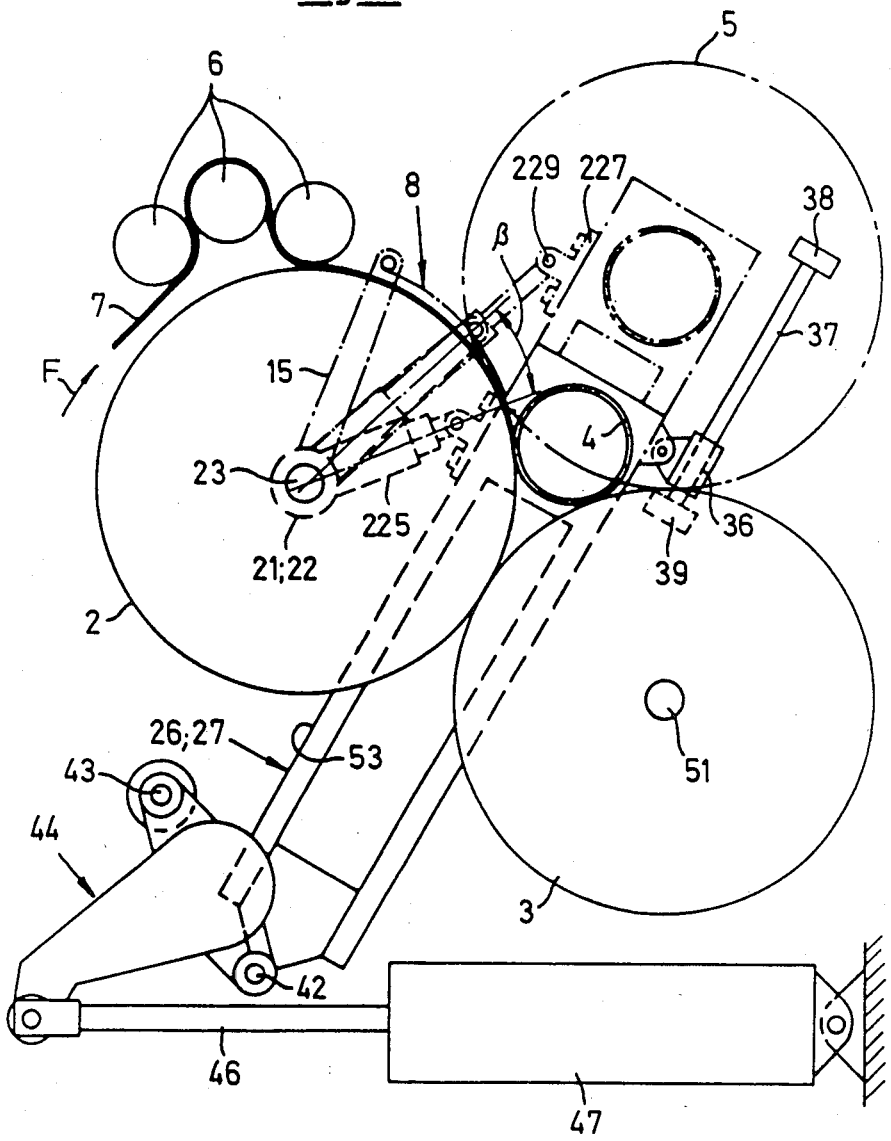
Figure 9:
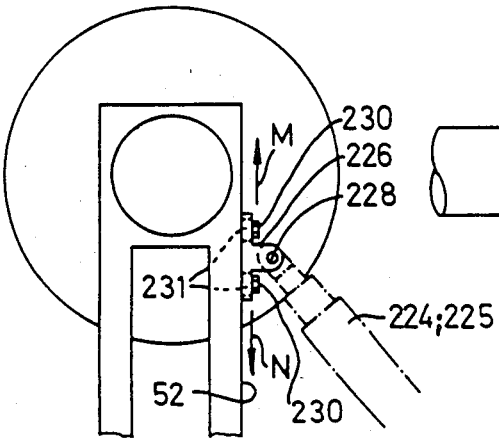
Figure 18:
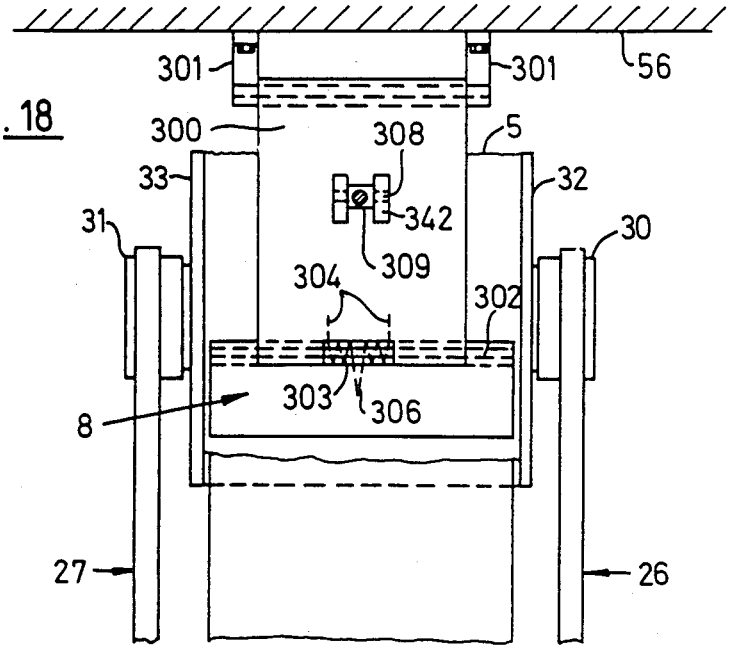
Figure 10:
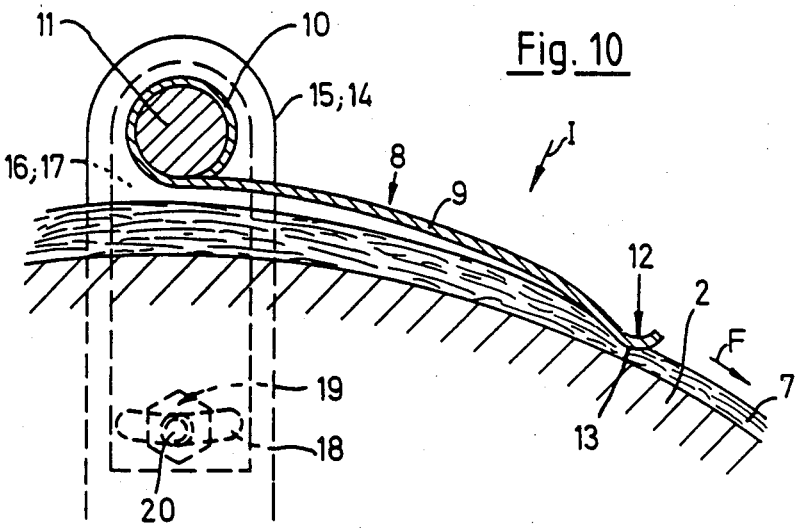
Figure 11:
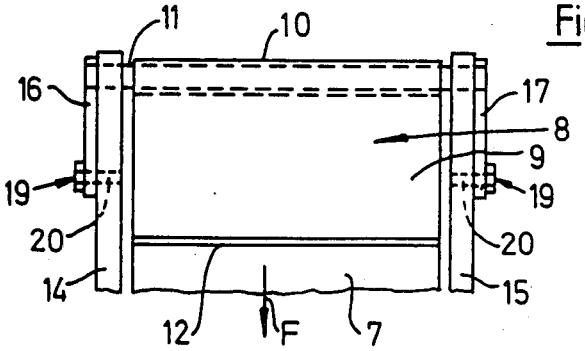
Figure 12:
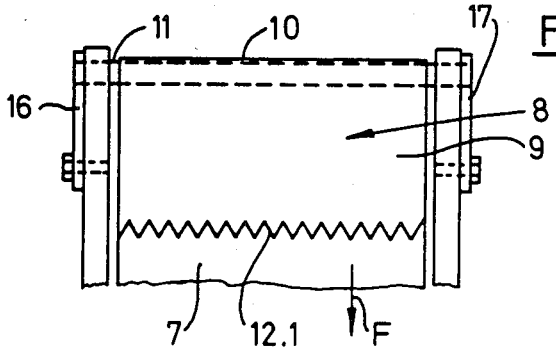
Figure 17:
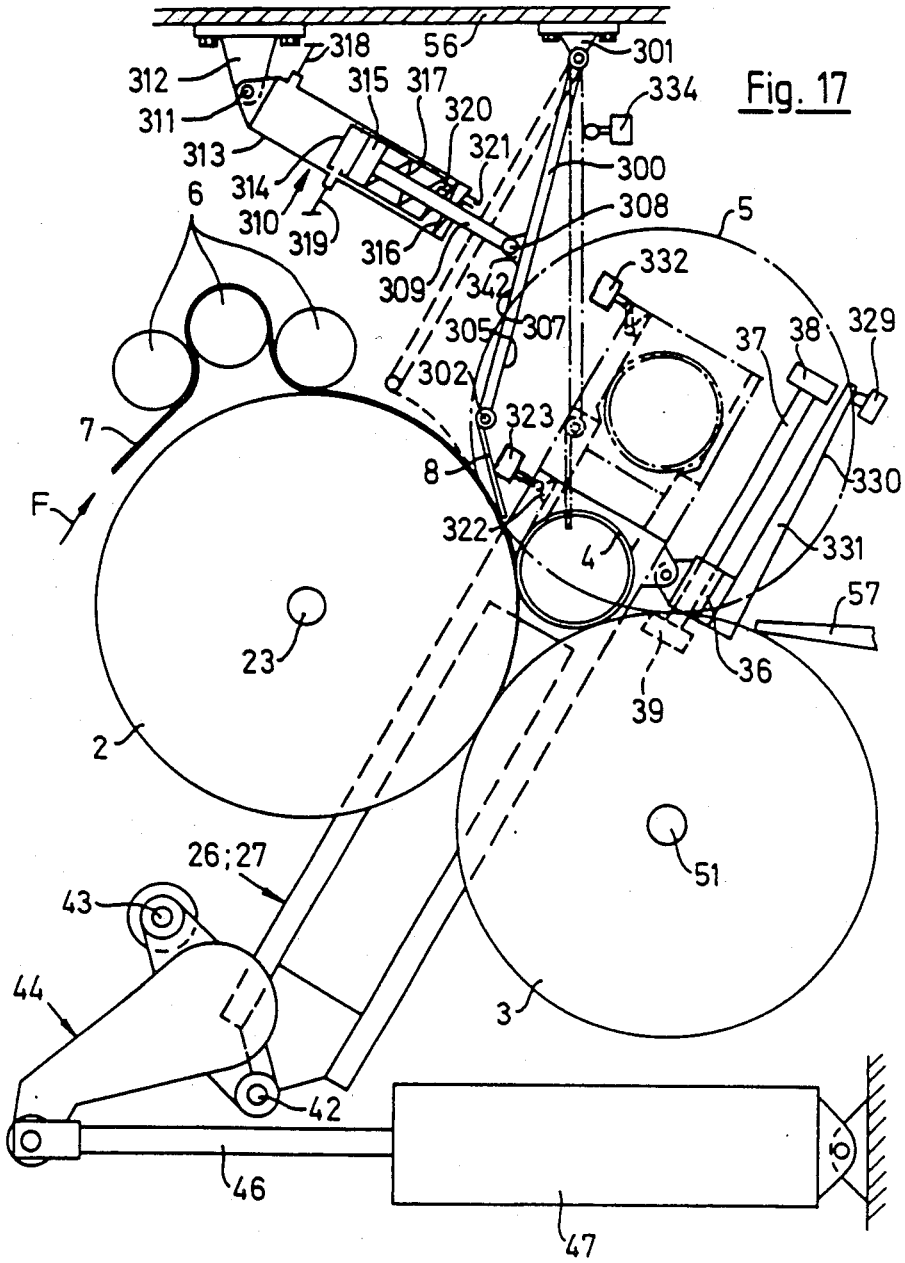
Figure 19:
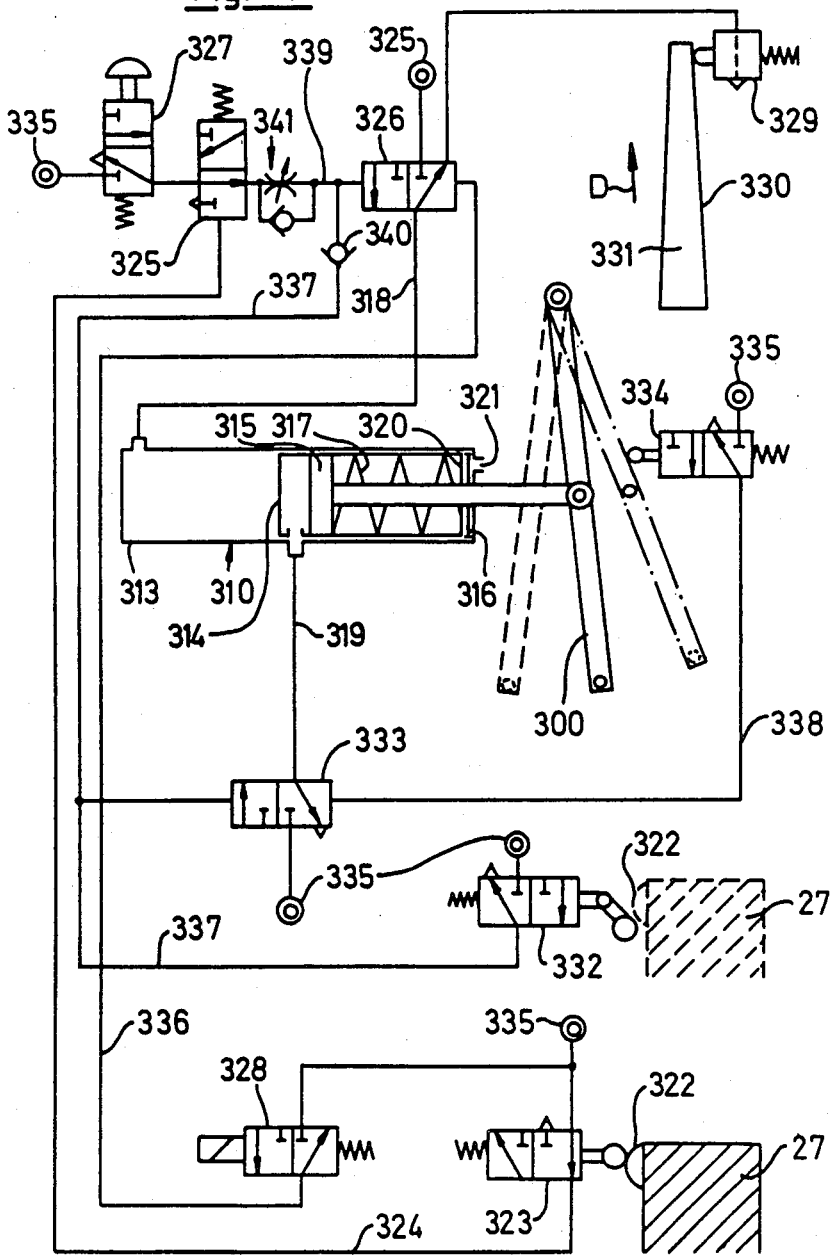
Figure 20:
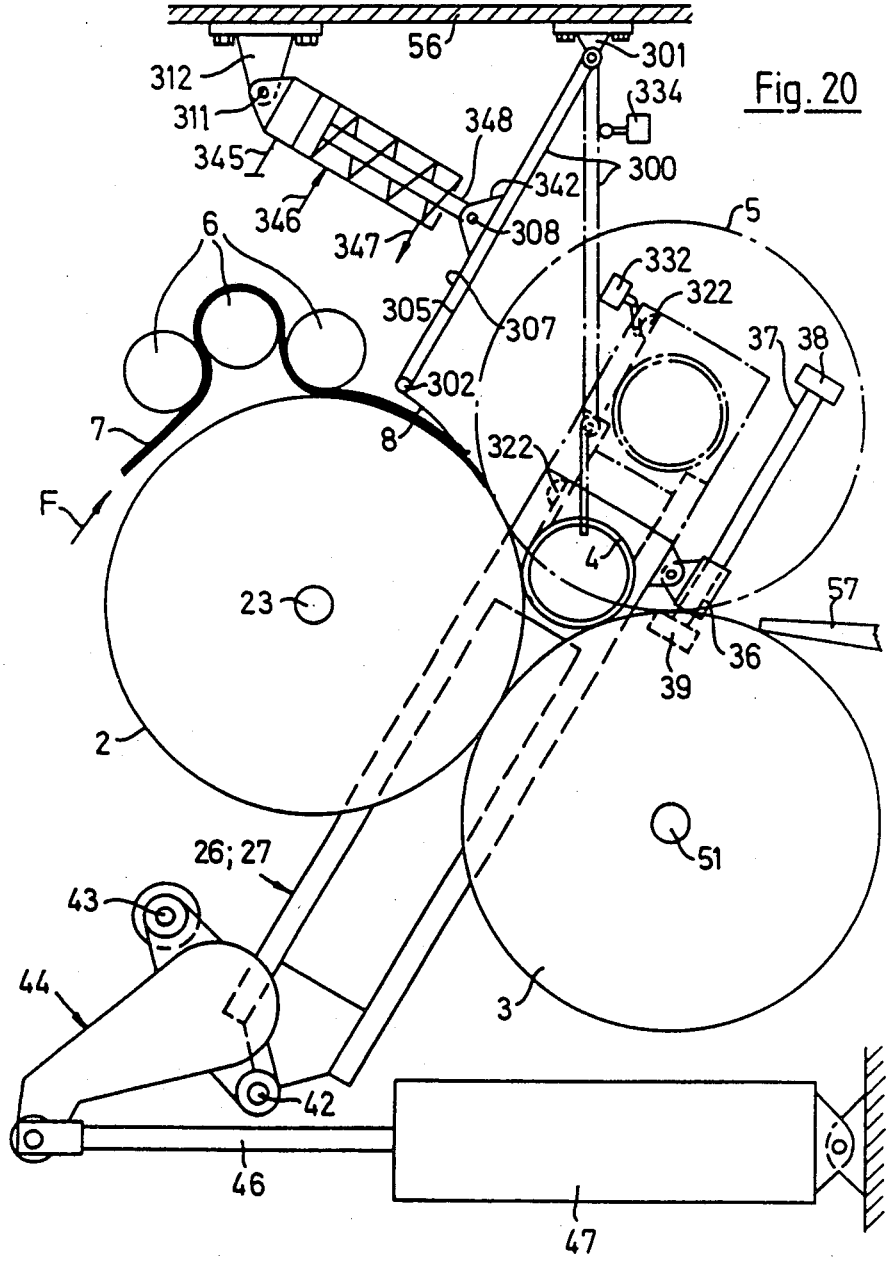
Figure 21:
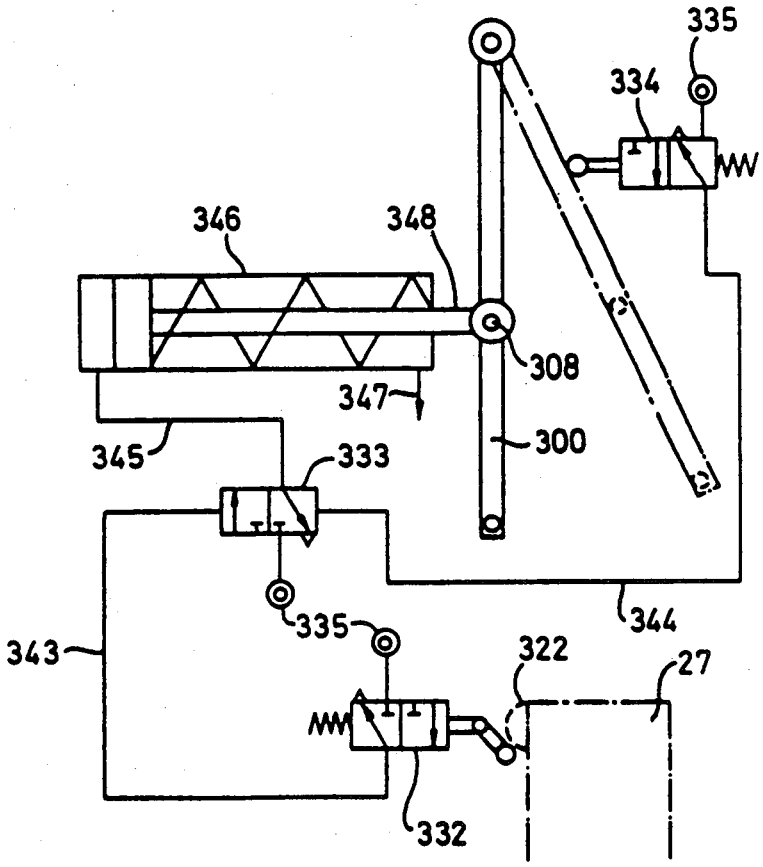

FIGS. *7a*, *8a* and *9a* are respective top plan views of the details shown in FIGS. 7, 8 and 9, respectively;

FIG. 10 is a partly sectional side elevational view of a detail of the lap winding apparatus of FIGS. 1, 2 and 3, at an enlarged scale;

FIG. 11 is a top plan view of the detail of FIG. 10 seen in the direction I of FIG. 10, at a reduced scale;

FIG. 12 is a view similar to FIG. 11 but showing a modification;

FIG. 13 is a view similar to FIG. 10 but showing a detail of a further modification of the lap winding apparatus of FIGS. 1, 2 and 3;

FIG. 14 is a view similar to FIG. 11 but of the detail of FIG. 13 as seen in the direction II of FIG. 13;

FIGS. 15 and 16 are top plan views of respective details of the apparatus according to the invention, at a larger scale and partly diagrammatic;

FIG. 17 is another view similar to FIG. 1 but showing, in cross section, an additional modification of the winding apparatus according to the invention;

FIG. 18 is a partly diagrammatic top plan view of a detail according to the invention of the lap winding apparatus modification shown in FIG. 17;

FIG. 19 is a diagrammatic representation of a pneumatic circuit and the components incorporated therein for controlling the operation of the lap winding apparatus of FIG. 17;

FIG. 20 is a view akin to FIG. 17 but showing, in cross section, a further modification of the lap winding apparatus of the invention; and FIG. 21 is a diagrammatic representation of a pneumatic circuit and the components incorporated therein for controlling the operation of the modified construction of the lap winding apparatus as shown in FIG. 20.

DETAILED DESCRIPTION OF THE PREFERRED EMBODIMENTS

Referring now to the drawings in detail, and first to FIG. 1 thereof, it may be seen that the reference numeral 1 has been used therein to identify a wadding lap winding apparatus of the present invention in its entirety. The apparatus 1 comprises a first winding roller 2 and a second winding roller 3 for receiving a core tube 4 or a wadding lap 5 formed on the tube 4.

Calender rollers 6 are arranged upstream of the first winding roller 2 and operate to condense a wadding web 7 that is fed in the direction of an arrow F. Downstream of the last calender roller 6, as viewed in the feed direction F, the wadding web 7 passes on to the first winding roller 2 and thereafter from the latter on to the tube 4 or the previously formed portion of the wadding lap 5.

A smoothing plate 8 provided downstream of the last calender roller 6 smoothes the wadding web 7 resting on the first winding roller 2 immediately before it is taken up by the tube 4 or the wadding lap 5, respectively, in such manner that the increased thickness of the wadding web 7, caused by so called "breathing" of the wadding material of the web 7 occuring downstream of the calender rollers 6, is reduced again for formation of the wadding lap 5. Thus, immediately before the formation of the wadding lap 5, the wadding web 7 is subjected to increased condensation that is desired for increasing the specific weight of the lap 5.

As shown in FIG. 10, the smoothing plate 8 comprises a resilient tongue 9 having a rear end 10 as viewed in the feed direction F of the wadding web 7, which is rolled around a shaft 11 and is fixedly secured to this shaft 11. A front end 12 of the tongue 9, also called the smoothing edge, has a curved portion 13 directed towards the wadding web 7. This curved portion 13 is pressed against the wadding web 7 by the spring force of the tongue 9 to produce the above-mentioned condensation or compression.

The shaft 11 is rotatably supported at its respective ends in respective swing arms 14 and 15 shown particularly in FIG. 11. Such ends are also fixedly secured to respective pivot levers 16, 17. Each pivot lever 16 and 17 has a slot 18 (FIG. 10) through which respective screws 19 project. The screws 19 have threads 20 which are received in the arms 14 and 15 respectively. By means of these screws 19, the pivot levers 16 and 17 respectively are held in their desired positions, the selectable positions being limited by the length of the slot 18. The adjustment of this position effects an adjustment of the spring force of the tongue 9.

Figure 4:
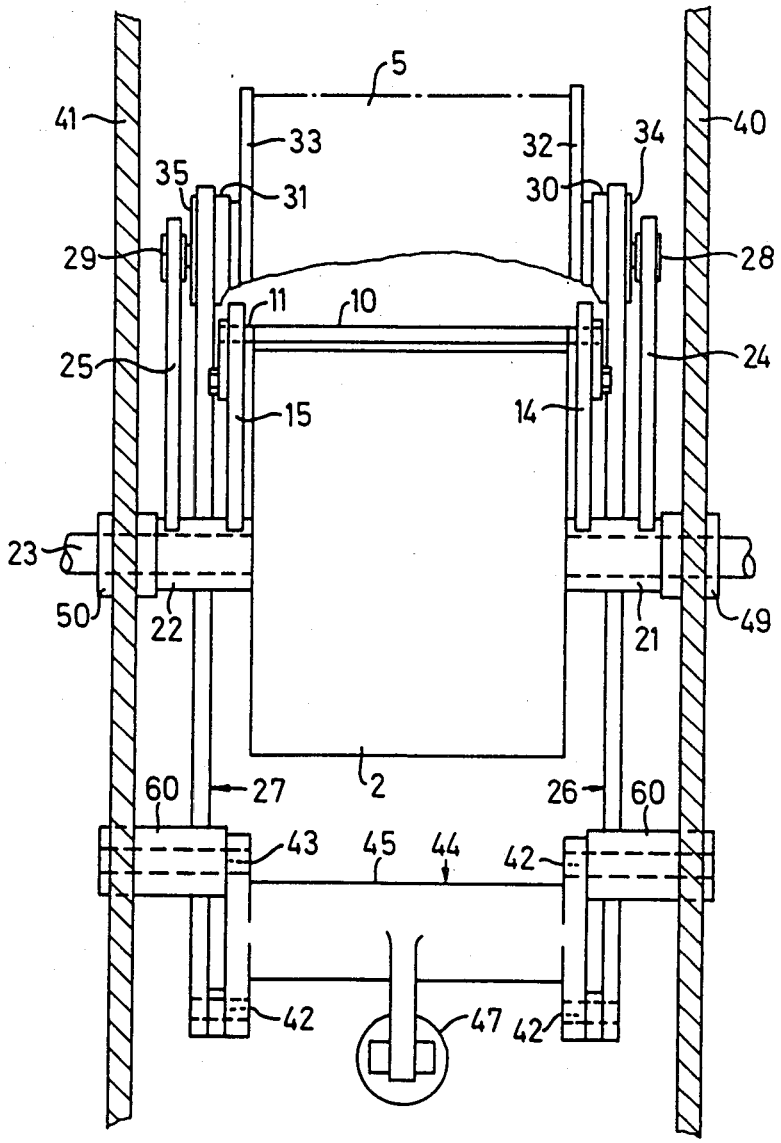
FIGS. 4, 5 and 6 are respective partly diagrammatic longitudinal sectional views of the lap winding apparatus of FIGS. 1, 2 and 3, respectively.
Figure 5:
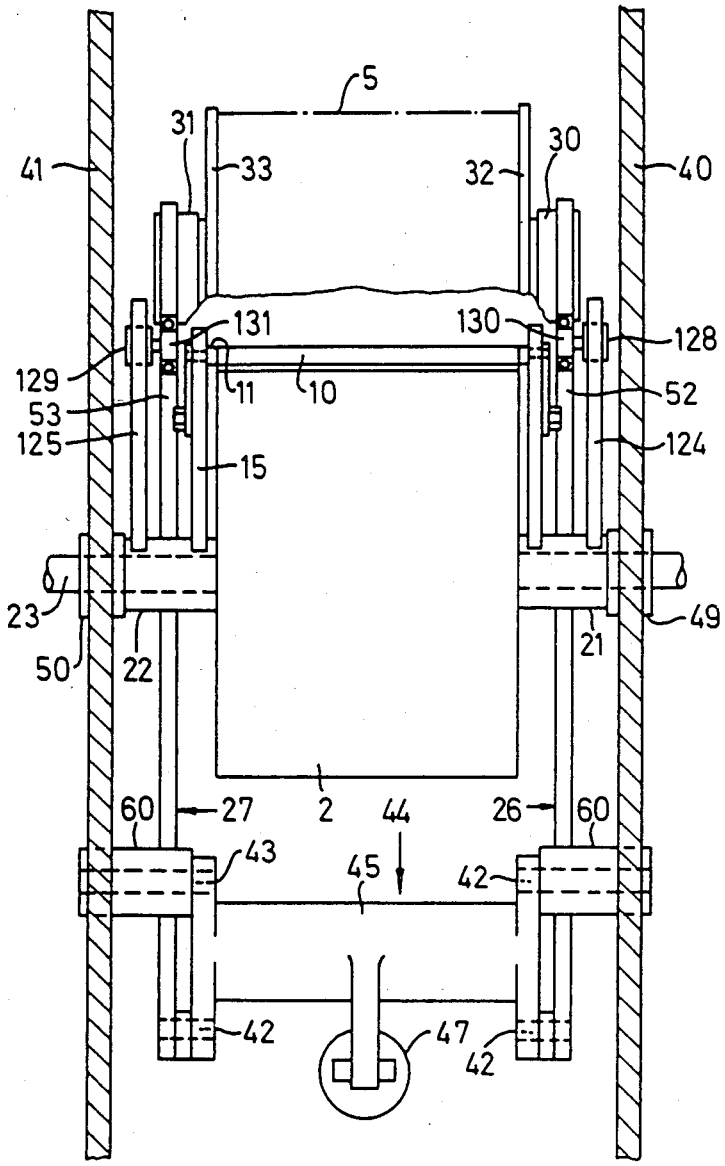
Figure 6:
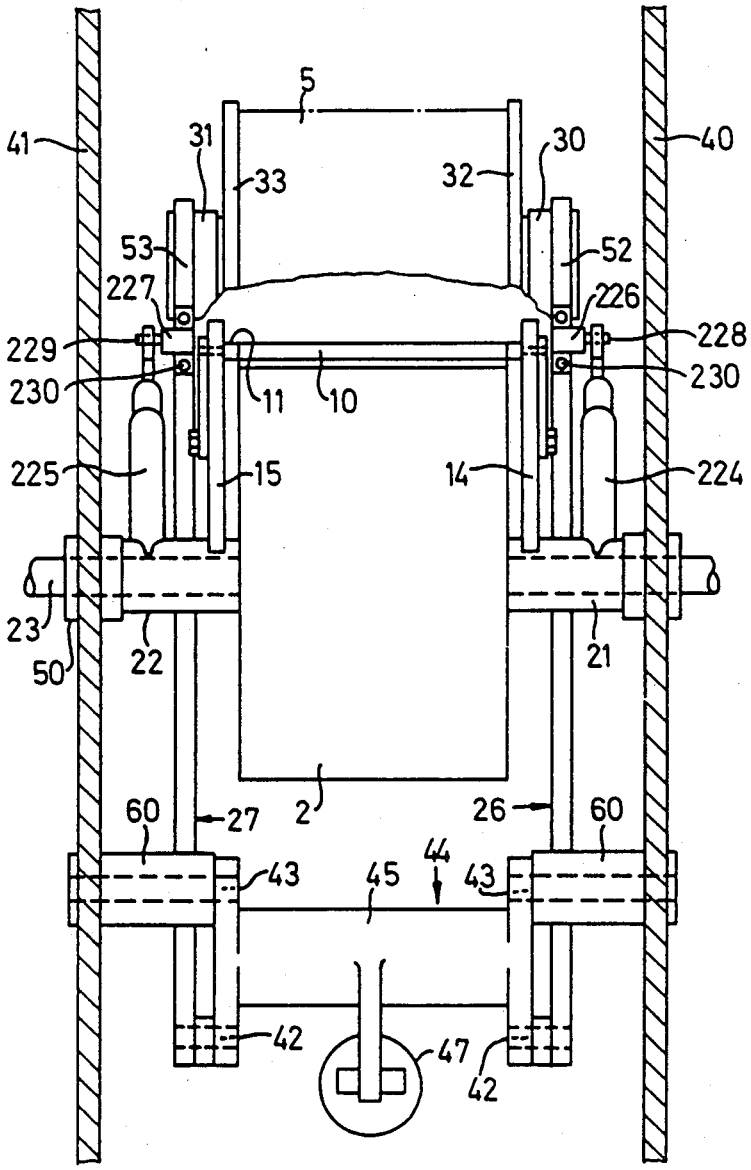

As illustrated particularly in FIG. 4, the two swing arms 14 and 15 are fixedly secured to respective sleeves 21 and 22 which, in turn, are rotatably supported on a shaft 23 associated with the first winding roller 2. Force transmitting levers 24 and 25 respectively are fixedly secured to respective sleeves 21 and 22 for operating the swing arms 14 and 15, respectively. The force transmitting lever 24 is supported on a roller 28 associated with a support arm 26 and the force transmitting lever 25 is supported on a roller 29 associated with a support arm 27. These support arms 26 and 27 receive the tube 4 or the wadding lap 5, for which purpose the support arms 26 and 27, respectively, are provided at their free end portions with pneumatic cylinders 30 and 31, respectively, and with lap limiting discs 32 and 33, respectively, that are concentric to the pneumatic cylinders 30 and 31. These components 30 to 33 have been omitted from FIG. 1 for the sake of clarity. In order to secure the tube 4, the pistons (not shown) of the pneumatic cylinders 30 and 31 are pushed into the tube 4.

The rollers 28 and 29 are associated with the support arms 26 and 27, respectively, in so far as they are secured to respective rear portions 34 and 35 of the respective pneumatic cylinders 30 and 31 that face towards the lap limiting discs 32 and 33 respectively, as shown in FIGS. 4, 7 and 7*a*. Each of the support arms 26 and 27 is pivotally secured at its free end portion to a slide element 36 (illustrated in FIG. 1 only for one support arm), which is guided by a slide rail 37. The slide rail 37 itself is secured (by securing means that is not shown) at both ends via respective carriers 38 and 39 to respective side walls 40 and 41 (FIG. 4) forming parts of the lap winding apparatus.

As also shown in FIG. 3, the support arms 26 and 27 are pivotally secured at their other end portions by means of a pivot shaft 42 to a pivoting mechanism 44 which, in turn, is pivotally supported by means of pivot axles 43 in bearing members 60 associated with the side walls 40 and 41, respectively. A central portion 45 of the pivoting mechanism 44 is also pivotally secured to a piston rod 46 of a pneumatic cylinder 47 pivotally mounted on a stationary support 59.

In operation, that is, during the build-up of the wadding lap 5, the pneumatic cylinders 47 are controlled, by a control which is not illustrated and which does not form part of this invention but is described and illustrated in the Swiss Patent Application No. 5561/83-3 in the name of the assignee of this application, in such a manner that the support arms 26 and 27, and thus the tube 4, are moved from their starting positions shown in FIG. 1 (represented in full lines) gradually into their final positions (represented in dash-dotted lines in FIG. 1). During this movement, the force transmitting levers 24 and 25, and thus of necessity the swing arms 14 and 15, and the smoothing plate 8, are moved back from their starting positions (illustrated in full lines in FIG. 1) into their end positions (represented in dash-dotted lines in FIG. 1).

In order to perform this movement of the smoothing plate 8 in such a manner that during increase in size of the wadding lap 5 the front end 12 of the smoothing plate 8 remains at a spacing of only a few centimeters, for example 2 centimeters, from the circumference of the wadding lap 5, control surfaces 48 of the force transmitting levers 24 and 25, respectively, that rest on the rollers 28 and 29, are correspondingly provided with a curvature illustrated in FIGS. 1 and 7. The degree and form of the curvature must be determined from case to case in dependence upon the design of the machine; the term "form" of the curvature refers to the change in the radius of curvature (FIG. 1) of the control surface 48 from the starting position indicated with the radius of curvature $r_1$ up to the end position of the roller 28 indicated with the radius of curvature $r_2$.

Finally, as visible in FIG. 4, the shaft 23 is rotatably received in bearings 49 and 50 fixedly secured in the side walls 40 and 41, respectively, and a shaft 51 (FIG. 1) supporting the second winding roller 3 is also rotatably received in bearings (not shown) fixedly mounted in the side walls 40 and 41, respectively. The drive for the shaft 51 and the transmission from this shaft 51 to the shaft 23 are not illustrated and do not form part of the invention, but they are effected in a known manner utilizing chain transmissions.

FIGS. 2, 5, 8 and 8A show a modification of the apparatus illustrated in FIGS. 1, 4, 7 and 7A, wherein all similar and/or similarly functioning elements are indicated with the same reference numerals and are therefore not described once more in detail.

This modification involves the replacement of the force transmitting levers 24 and 25 by force transmitting levers 124 and 125, respectively, and the replacement of the rollers 28 and 29 by rollers 128 and 129 respectively. The force transmitting levers 124 and 125 are fixedly secured to the sleeves 21 and 22, respectively. The rollers 128 and 129 are rotatably supported in respective bearings 130 and 131 which are secured in turn to sides 52 and 53 of the support arms 26 and 27 respectively facing towards the shaft 23.

The position of these bearings 130 and 131 on the sides 52 and 53, respectively, is to be determined, in relation to a spacing D, from case to case in dependence on the design of the machine, the spacing D being the spacing between a plane 54 containing the longitudinal axes (not shown) of the shafts 23 and 51 and a plane 55 parallel to the plane 54 and containing the longitudinal axes (not shown) of the rollers 128 and 129 respectively. This spacing D must be chosen in relation to the form of the curvature shown in FIGS. 2 and 8 of the control surfaces 148 associated respectively with the force transmitting levers 124 and 125 and resting on the rollers 128 and 129. The expression "form" of the curvature, as already described above, refers to the change in the radius of curvature of the control surface 148 from the starting position indicated with the radius of curvature $r_{10}$ to the end positions of the rollers 128 and 129, indicated with the radius of curvature $r_{20}$. This starting position is, as shown in FIG. 2, that position in which the spacing D is maintained.

In operation, that is during the build-up of the wadding lap 5, the lap winding apparatus functions in the previously described manner, the force transmitting levers 124 and 125 moving the swing arms 14 and 15, and thus the smoothing plate 8, from the starting position into the end position.

FIGS. 3, 6, 9 and 9A show a further modification of the apparatus described above with reference to FIGS. 1, 4, 7 and 7A. Accordingly, similar and/or similarly functioning elements have also been indicated by the same reference numerals in this modification and will not be described again.

In this modification, the swing arms 14 and 15 are pivoted by means of telescoping arms 224 and 225 respectively from the previously mentioned starting position into the end position. The telescoping arms 224 and 225 are, for this reason, on the one hand fixedly secured to the sleeves 21 and 22, respectively, and on the other hand pivotally secured by means of pivot pins 228 and 229, respectively, to respective supports 226 and 227 on the respective sides 52 and 53 of the support arms 26 and 27, respectively. The supports 226 and 227 are secured, in turn, by means of screws 230, to the support arms 26 and 27, respectively.

Figure 9A:
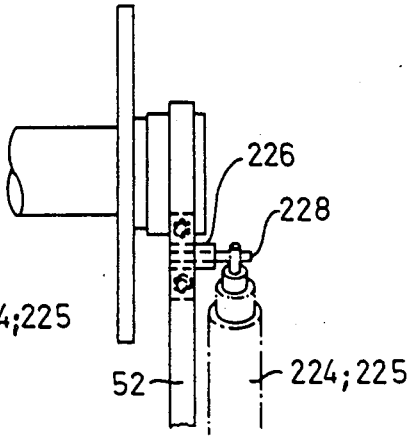

In order to be able to adjust the positions of these supports 226 and 227 within a given region, the screws 230 are guided, as indicated in FIGS. 9 and 9A, in the provided slots 231 so that, upon loosening of the screws 230, these supports 226 and 227 are movable in a direction M or N indicated in FIG. 9. The reason for the adjustability in the position of these supports 226 and 227 is to enable adjustment of a pivot angle $\beta$ through which telescoping arms 224 and 225 are pivoted. For example, upon movement of these supports 226 and 227 in the direction M, the pivot angle $\beta$ is reduced, while during movement of the supports 226 and 227 in the opposite direction (the direction N) the pivot angle $\beta$ is increased. The adjustment of the pivot angle $\beta$ serves for adaptation of the spacing between the front end 12 of the smoothing plate 8 and the wadding lap 5 which is gradually increasing in size in operation, which means that, in operation, with increasing spacing between the front end 12 and the wadding lap 5, the supports 226 and 227 are moved so far in the direction M that this spacing is maintained substantially constant.

Finally, FIGS. 17 and 18 show another modification in which the previously illustrated and described elements of the same type and/or same function are provided with the same reference numerals. In this modification, the smoothing plate 8 is pivotally secured to a pendulum bar 300 by means of an axle 302; the bar 300 in in turn also pivotally mounted in two supports 301. The supports 301 are stationarily mounted on a cover 56 forming part of the lap winding apparatus 1 and connected to the side walls 40 and 41.

In order to produce the pressing force for the smoothing plate 8 on the wadding web 7, a spring 303 (FIG. 18) is wound about the axle 302 in such manner that it presses with both of its ends 304 on a side 305 of the pendulum bar 300 that faces towards the wadding lap 5, and that it presses with a loop portion 306 provided in the middle of the spring 303 on the side of the smoothing plate 8 facing towards the wadding lap 5. On the side 307 facing the side 305, the pendulum bar 300 is pivotally connected by means of a pin 308 with a piston rod 309 of a single-operating two-state pneumatic cylinder 310. This pneumatic cylinder 310 is, in turn, pivotally connected by means of a pin 311 to a carrier 312 stationarily secured to the cover 56.

The pneumatic cylinder 310 comprises a cylinder housing 313, a hollow cylinder-piston 314 movable therein and a piston 315 movable therein, with which the piston rod 309 is associated. A compression spring 316 is compressed between the end face of the cylindrical housing 313 associated with the piston rod 309 and the end face of the cylindrical piston 314 associated with the piston rod 309. In the unpressurized condition, the spring 316 causes return of the cylindrical piston 314 into its starting position (indicated in dotted lines in FIG. 17) while the movement of the piston 315 into its starting position is caused in the unpressurized condition by a second compression spring 317 compressed between the piston 315 and the end face of the cylindrical piston 314 associated with the piston rod 309.

For the forward movement of the cylindrical piston 314 against the force of the first compression spring 316, the cylindrical housing 313 is supplied with pressure air by way of a first pressure air lead 318; for the forward movement of the piston 315, the cylindrical piston 314 is supplied with pressure air by means of a pressure air lead 319. For the cylindrical piston 314, this movement occurs from the starting position illustrated in dotted lines in FIG. 17 into the end position indicated in full lines; for the piston 315 this movement occurs from the starting position illustrated in FIG. 17 into a nonillustrated end position in which the pendulum bar 300 takes up the position illustrated in dotted lines in FIGS. 17 and 19. Due to the movement of the cylindrical piston 314 from its starting position into its end position the pendulum bar 300 is pivoted from its end position illustrated in dotted lines in FIGS. 17 and 19 into its starting position illustrated in full lines. Due to the movement of the piston 315 from its starting position into its end position, the pendulum bar 300 is pivoted further into the so-called ejection position (illustrated in dotted lines in FIGS. 17 and 19), in which a completed lap 5 is pushed out onto a receiver plate 57. During the movement of the cylindrical piston 314 and/or the piston 315, the cylinder 313 and/or the cylindrical piston 314 is exhausted via exhaust ports 320 and 321, respectively. Lengthening or shortening of the pivot path of the pendulum bar 300 can be achieved by adjustment of the position of a hinge joint 342, containing the pin 308, along the pendulum bar 300.

During start up of the lap winding apparatus, the support arms 26 and 27 are in their lower position shown in FIG. 17, in which an empty tube 4 placed upon the wind-up rollers 2 and 3 can be grasped by the pneumatic cylinders 30, 31.

In this position, a switching cam 322 provided on the support arm 27 operates 3/2-way valve 323 (with a flow-blocking 0 position) controlled by a feeler roller so that a control lead 324 is supplied with pressure air, thus operating 3/2-way valve 325 (with a flow-blocking 0 position) pressure controlled from one side. Through the operation of the valve 325, the way is free for the operation of a 3/2-way sliding valve 326 (pressure controlled on both sides) in the blocking position connected to the valve 325 by means of a control lead 339. The valve 326 is operated in such a manner that, through a short operation of a 3/2-way valve 327 (with a flow-blocking 0 position) controlled by means of a press button, the sliding valve 326 is switched over to permit through-flow of pressure air and thus the pressure lead 318 is pressurized. The pendulum bar 300 is thereby brought into the start position.

Upon start of the lap winding operation, an electromagnetically controlled 3/2-way valve 328 (with a flow-blocking 0 position) is operated briefly, so that a control lead 336 is briefly supplied with pressure and thus the sliding valve 326 is moved back into the starting position shown in FIG. 19. Thus, the pressure lead 318 is connected via the sliding valve 326 with a pressure regulating valve 329 controlled by means of a feeler roller and having an exhaust opening. The feeler roller of the pressure regulating valve 329 rests on a control surface 330 of a linear control cam 331 connected with the slide element 36.

Due to the movement of the support arms 26, 27 with the increasing size of the lap 5, the linear cam 331 is forced to move in the direction indicated in FIG. 19 by the arrow D so that the position of the feeler roller is changed in such a manner, and so that the pressure regulating valve 329 is controlled in such a manner that the pressure in the pressure lead 318 is gradually reduced. The control surface 330 is formed in such a manner continually from the starting position into the end position illustrated in dotted lines in FIGS. 17 and 19 that the spacing of the front end 12 of the smoothing plate 8 to the wadding lap 5 remains substantially the same.

When the final diameter of the wadding lap 5 is reached, the switching cam 322 briefly operates a 3/2-way valve 332 (with flow-blocking 0 position) controlled by means of a feeler roller, which valve 332 thereupon controls the slide valve 326 via a control lead 337 in such a manner that it is again moved into the through-flow position, whereby the pressure lead 318 is supplied with pressure and the cylindrical piston 314 is moved into its end position against the spring force. Simultaneously, that is, with the same pressure impulse, a further 3/2-way sliding valve 333, in the blocking position and connected with the control lead 337, is operated in such a manner that it is moved out of the blocking position into the through-flow position and thus the pressure lead 319 is supplied with pressure. Thus, the piston 315 is moved out of its starting position shown in FIG. 17 against the pressure of the spring 317 into its end position (not shown) immediately after the cylindrical piston 314 has reached the end position. As a result, the pendulum bar 300 is brought into the ejection position illustrated in dotted lines in FIGS. 17 and 19 so that the completed wadding lap 5 is pushed out onto the receiving plate 57 and can be removed from the lap winding apparatus 1. In this ejection position, the pendulum bar 300 operates a 3/2-way valve 334 (with a flow-blocking 0 position) operable by a feeler roller, which valve 334 is connected via a control lead 338 with the sliding valve 333 and, thereby, the latter is moved back into the blocking position so that the pressure lead 319 is vented again and the piston 315 is also returned by the force spring 317 into its starting position. The pendulum bar 300 has thereby again reached its starting position illustrated in full lines.

When the support arms 26 and 27 have been lowered, the valve 332 is not operated because of the idling return of the feeler roller so that the slide valve 333 remains in the blocking position. When the support arms 26 and 27 have again reached the starting position, the valve 323 and thus the valve 325 is operated again. However, in the absence of the operation of the valve 327, which is not necessary in this situation, this operation of the valves 323 and 325 remains without effect on the sliding valve 326. The sliding valve 326 is then brought into the 0 position illustrated in FIG. 19 when, after a new tube 4 has been put in place, the valve 328 is operated upon the start of the winding operation, that is, it is started up by means of an electrical control pulse and the control lead 336 is briefly pressurized. The described operation of the lap build-up is now repeated.

The pressurized air required for the described operation is fed to the pressure air connections 335. In order to avoid supply of pressure to the control lead 337 simultaneously with the previously mentioned operation of the valve 327, a non-return valve 340 is included in this control lead 337 immediately upstream of the connection with the control lead 339. Finally, provided in the control lead 339 between the connection with the control lead 337 and the valve 325, there is provided an adjustable throttling/non-return valve combination 341 with a blocking effect directed against the valve 325. The throttle of this valve combination 341 is so adjusted that, on the one hand, a pressure impulse coming from the control lead 339 operates the valve 326 with sufficient pressure and, on the other hand, venting of the control lead 339 is possible via the valve 325. The associated non-return valve of the valve combination 341 permits a pressure impulse issued from the valve 327 to bypass the throttle of this combination 341.

FIG. 12 shows that the front end, also called the smoothing edge, of the smoothing plate 8 can be formed as a toothed front end 12.1. The advantage of such teeth can be explained in the following manner with reference to FIGS. 15 and 16.

The wadding web 7 that is moved in the feed direction F comprises a layer of fibers 58 which have an orientation directed substantially in the feed direction F, that is, fibers which (in a somewhat exaggerated description of the actual situation) lie substantially parallel next to and on top of each other and thereby form the wadding web 7. Through this parallel disposition of the fibers 58, there arises a certain possibility that, during the formation of the wadding lap 5, fibers of neighboring surfaces come into neighboring positions and thereby, as a result of the winding pressure, are driven into each other in such a fashion that a certain danger of mutual adhesion of the surfaces arises. This adhesion can be disadvantageous during unrolling of the wadding lap 5 in that the wadding lap 5 either unrolls relatively poorly or that during unrolling of the lap 5, that is during separation of the superimposed layers of the web, complete clumps of fibers can be dragged out of the one surface and can remain hanging on the opposite surface as a thickening formation thereon. In order to reduce this disadvantage at least partially, the front end of the smoothing plate 8 is provided with teeth 12.1, which, at least partially and at least at the surface, divert the substantially parallel lying fibers 58 so that the fibers 58 at the surface receive a random orientation at least to a certain degree. This random orientation assists in acting against the adhesion of any superimposed two web layers.

In order to combine the smoothing effect on the straight front end 12 with the advantageous random disposition effect of the teeth 12.1. It is proposed, as illustrated in FIGS. 13 and 14, to combine the resilient tongue 9 provided with the teeth 12.1 with a tongue 9.1 secured thereto, the front end 12 of the tongue 9.1 being straight and being provided downstream from the teeth 12.1 as viewed in the feed direction F. This combination is referred to as a smoothing plate 8.1 and is secured in the same manner as the smoothing plate 8.

Further, FIG. 20 shows a simplified modification of the apparatus of FIG. 17. Correspondingly, similar elements are identified by the same reference numerals.

In this modification, the smoothing plate 8 does not move with increasing size of the wadding lap 5 but remains, during the course of the formation of the wadding lap 5, in the end position illustrated in full lines in FIG. 20.

After completion of the wadding lap 5, the pendulum bar 300 is brought into its ejection position illustrated in dotted lines in order thereby to push the complete lap 5 onto the receiver plate 57.

In operation, the previously mentioned control system, described in Swiss Patent Application No. 5561/83-3 controls the wadding lap formation in the previously mentioned manner. On completion of the wadding lap 5, that is in the upper end position of the support arms 26 and 27, the switching cam 322 operates the valve 332 whereby the valve 333 is operated via the control lead 343 such that a pressure lead 345 connecting the valve 333 with a single operating pneumatic cylinder 346 is supplied with pressure air. Thus, upon venting of the cylinder chamber associated with the piston rod via the lead 347, the piston rod 348 is moved against the force of the spring of the cylinder 346 until the pendulum bar 300 has reached the ejection position.

In this position, the valve 334 is operated by the pendulum bar 300 in such a manner that a control lead joining the valve 334 to the valve 333 is supplied with pressure. Thus, the valve 333 is moved back again into the position in which the pressure lead 345 is vented and the piston rod 348 is moved back into the starting position. The build-up of the wadding lap 5 can now begin again from the start. Finally, it is to be mentioned that the smoothing plate 8 or 8.1 can also be provided in a stationary manner in which, for example, the pendulum bar 300 in operation remains in its end position illustrated in dotted lines in FIG. 17.

It will be understood that each of the elements described above, or two or more together, may also find a useful application in other types of arrangements differing from the type described above.

While the invention has been illustrated and described as embodied in an apparatus for forming laps from wadding webs, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without ommiting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

We claim:

1. A winding apparatus for forming a lap from a fibrous web, comprising means for winding the web at a lap-forming location into the lap with attendant advancement of the web in a predetermined path toward said lap-forming location, including two winding rollers which support the lap during the winding of the latter; means for calendering the web in said path upstream of said lap-forming location; and means for preparing the web for the formation of the lap therefrom, such preparing means being situated between said calendering means and said lap-forming location and including a smoothing plate that is so arranged as to press the web against that of the winding rollers that is arranged along said path upstream of said lap-forming location to thereby condense the material of the web so close to the location of transfer of the web onto the lap that the fibrous web does not expand to any significant extent prior to being wound onto the lap, said smoothing plate having a substantially straight smoothing edge extending substantially transversely of the web and arranged at the downstream end of said smoothing plate as considered in the advancement direction of the web, said smoothing edge including a row of teeth arranged next to one another as considered transversely of the web.

2. A winding apparatus for forming a lap from a fibrous web, comprising means for windig the web at a lap-forming location into the lap with attendant advancement of the web in a predetermined path toward said lap-forming location, including two winding rollers which support the lap during the winding of the latter; means for calendering the web in said path upstream of said lap-forming location; and means for preparing the web for the formation of the lap therefrom, such preparing means being situated between said calendering means and said lap-forming location and including a smoothing plate that is so arranged as to press the web against that of the winding rollers that is arranged along said path upstream of said lap-forming location to thereby condense the material of the web so close to the location of transfer of the web onto the lap that the fibrous web does not expand to any significant extent prior to being wound onto the lap, said smoothing plate including two smoothing edges extending substantially transversely of the web, one of said smoothing edges being situated downstream of the other as considered in the advancement direction of the web, said other smoothing edge having a row of teeth arranged next to one another as considered transversely of the web, while said one smoothing edge extends along a substantially straight course.

3. The winding apparatus as defined in claim 2, wherein said one smoothing edge is constructed as a substantially straight bending portion.

4. The winding apparatus as defined in claim 2, wherein said one smoothing edge includes a bulge.

5. A winding apparatus for forming a lap from a fibrous web, comprising means for winding the web at a lap-forming location into the lap with attendant advancement of the web in a predetermined path toward said lap-forming location, including two winding rollers which support the lap during the winding of the latter; means for calendering the web in said path upstream of said lap-forming location; and means for preparing the web for the formation of the lap therefrom, such preparing means being situated between said calendering means and said lap-forming location and including a smoothing plate that is so arranged as to press the web against that of the winding rollers that is arranged along said path upstream of said lap-forming location to thereby condense the material of the web so close to the location of transfer of the web onto the lap that the fibrous web does not expand to any significant extent prior to being wound onto the lap, said smoothing plate including at least one smoothing edge arranged at the downstream end of said smoothing plate as considered in the web advancement direction; and wherein said preparing means further includes means for mounting said smoothing plate for movement in such a trajectory that said smoothing edge is always situated in the immediate vicinity of the nip region formed between the web and the outer layer of the lap from the smallest to the largest lap diameter.

6. The winding apparatus as defined in claim 5, further comprising means for supporting a tube that constitutes the core of the lap and for moving the same toward and away from the winding rollers in dependence on the instantaneous diameter of the lap; wherein said preparing means further comprises means for moving said smoothing plate in said trajector; and further comprising means for controlling the operation of said moving means in dependence on the position of said supporting means.

7. A winding apparatus for forming a lap from a fibrous web, comprising means for winding the web at a lap-forming location into the lap with attendant advancement of the web in a predetermined path toward said lap-forming location, including two winding rollers which support the lap during the winding of the latter; means for calendering the web in said path upstream of said lap-forming location; and means for preparing the web for the formation of the lap therefrom, such preparing means being situated between said calendering means and said lap-forming location and including a smoothing plate that is so arranged as to press the web against that of the winding rollers that is arranged along said path upstream of said lap-forming location to thereby condense the material of the web so close to the location of transfer of the web onto the lap that the fibrous web does not expand to any significant extent prior to being wound onto the lap, said preparing means further including means for mounting said smoothing plate, including a pivotally mounted carrier, said carrier including two swing arms mounted for pivoting about the axis of that of said winding rollers which is arranged upstream of said lap-forming location; and further comprising means for moving said carrier, including at least one force-transmitting means rigidly secured at least to one of said swing arms, and means for controlling the movement of the carrier in dependence on the diameter of the lap.

8. The winding apparatus as defined in claim 7, further comprising means for supporting a tube that forms a core of the lap; and wherein said controlling means is operative for controlling the operation of said moving means in dependence on the position of said supporting means.

9. The winding apparatus as defined in claim 7, wherein said force-transmitting means includes a lever.

10. The winding apparatus as defined in claim 7, wherein said force-transmitting means includes a telescopic arm.

11. The winding apparatus as defined in claim 8, and further comprising means for moving said supporting means, including carrier arms movably arranged at the respective sides of said winding rollers.

12. The winding apparatus as defined in claim 11, wherein said force transmitting means includes a lever at each side of the winding rollers; and wherein each of said carrier arms includes a rotatable roller which is on contact with a control surface of the respective force-transmitting lever.

13. The winding apparatus as defined in claim 11, wherein said force-transmitting means includes a telescoping arm; and wherein each of said carrier arms is pivotally connected to said telescoping arm.

14. A winding apparatus for forming a lap from a fibrous web, comprising means for winding the web at a lap-forming location into the lap with attendant advancement of the web in a predetermined path toward said lap-forming location, including two winding rollers which support the lap during the winding of the latter; means for calendering the web in said path upstream of said lap-forming location; and means for preparing the web for the formation of the lap therefrom, such preparing means being situated between said calendering means and said lap-forming location and including a smoothing plate that is so arranged as to press the web against that of the winding rollers that is arranged along said path upstream of said lap-forming location to thereby condense the material of the web so close to the location of transfer of the web onto the lap that the fibrous web does not expand to any significant extent prior to being wound onto the lap, said smoothing plate including at least one smoothing edge arranged at the downstream end of said smoothing plate as considered in the web advancement direction; and wherein said preparing means further includes means for mounting said smoothing plate for movement in such a trajectory that said smoothing edge is always situated in the immediate vicinity of the nip region formed between the web and the outer layer of the lap from the smallest to the largest lap diameter; means for supporting a tube that constitutes the core of the lap and moving the same toward and away from the winding rollers in dependence on the instantaneous diameter of the lap; wherein said preparing means further comprises means for moving said smoothing plate in said trajectory; and further comprising means for controlling the operation of said moving means in dependence on the position of said supporting means; said mounting means includes a pivotally mounting pendulum bar; wherein said supporting means includes carrier arms; and wherein said controlling means so controls the operation of said moving means for said pendulum bar in dependence on the positions of said carrier arms that the smoothing plate is continuously moved out of a starting position in which said smoothing edge is situated at the nip region between the empty tube and the web through a plurality of intermediate positions in which said smoothing edge is situated with the increasing diameter of the lap at the nip region between the web and the outer layer of the lap to a final position corresponding to the largest possible diameter of the lap.

15. The winding apparatus as defined in claim 14, wherein said moving means includes a double-acting pneumatic cylinder-and-piston unit.

16. The winding apparatus as defined in claim 14, wherein said moving means includes a single-acting pneumatic cylinder-and-piston unit.

17. The winding apparatus as defined in claim 14, wherein said moving means is further capable of moving said pendulum bar beyond said final position toward an ejecting position; and wherein said controlling means controls said moving means at the end of the lap-forming operation to move said pendulum bar toward said ejection position thereof with attendant ejection of the full lap from the apparatus.

18. The winding apparatus as defined in claim 17, wherein said moving means includes respective single-acting two-stage pneumatic cylinders.

19. A winding apparatus for forming a lap from a fibrous web, comprising means for winding the web at a lap-forming location into the lap with attendant advancement of the web in a predetermined path toward said lap-forming location, including two winding rollers which support the lap during the winding of the latter; means for calendering the web in said path upstream of said lap-forming location; and means for preparing the web for the formation of the lap therefrom, such preparing means being situated between said calendering means and said lap-forming location and including a smoothing plate that is so arranged as to press the web against that of the winding rollers that is arranged along said path upstream of said lap-forming location to thereby condense the material of the web so close to the location of transfer of the web onto the lap that the fibrous web does not expand to any significant extent prior to being wound onto the lap, said preparing means further including means for mounting said smoothing plate, including a pendulum bar, wherein said pendulum bar is mounted for pivoting between two end positions in one of which it holds said smoothing plate at a nip region formed between the web and the outer layer of the lap; and further comprising means for moving said pendulum bar between said end position with attendant ejection of the formed lap from the lap-forming region during the movement of said pendulum bar toward said other end position thereof.

* * * * *